US008633654B2

(12) United States Patent
Keh et al.

(10) Patent No.: US 8,633,654 B2
(45) Date of Patent: Jan. 21, 2014

(54) LIGHT SOURCE DRIVING APPARATUS

(75) Inventors: Yong-Chan Keh, Seongnam-si (KR); Byeong-Hoon Park, Suwon-si (KR); Yong-Kwan Kim, Suwon-si (KR)

(73) Assignee: Samsung Electronics Co., Ltd (KR)

( * ) Notice: Subject to any disclaimer, the term of this patent is extended or adjusted under 35 U.S.C. 154(b) by 982 days.

(21) Appl. No.: 12/724,050

(22) Filed: Mar. 15, 2010

(65) Prior Publication Data

US 2010/0231137 A1 Sep. 16, 2010

(30) Foreign Application Priority Data

Mar. 13, 2009 (KR) ..... 10-2009-0021803

(51) Int. Cl.
*G05F 1/00* (2006.01)

(52) U.S. Cl.
USPC ..... 315/291; 315/224; 315/304; 315/297; 315/312

(58) Field of Classification Search
USPC ..... 315/247, 185 S, 209 R, 224, 225, 291, 315/307, 297, 312
See application file for complete search history.

(56) References Cited

U.S. PATENT DOCUMENTS

| | | | | |
|---|---|---|---|---|
| 7,554,065 | B2 * | 6/2009 | Shimizu | 250/205 |
| 7,728,798 | B2 * | 6/2010 | Kim | 345/82 |
| 7,888,888 | B2 * | 2/2011 | Huang et al. | 315/307 |
| 8,134,305 | B2 * | 3/2012 | Keh et al. | 315/291 |
| 2008/0150449 | A1 | 6/2008 | Wang et al. | |
| 2008/0179498 | A1 | 7/2008 | Shimizu | |
| 2008/0185978 | A1 * | 8/2008 | Jeong et al. | 315/297 |
| 2009/0224686 | A1 | 9/2009 | Kunimatsu | |
| 2012/0074865 | A1 * | 3/2012 | Lee et al. | 315/291 |

FOREIGN PATENT DOCUMENTS

| | | |
|---|---|---|
| JP | 2001-356829 | 12/2001 |
| JP | 2004-039289 | 2/2004 |
| WO | WO 2006/064841 | 6/2006 |

* cited by examiner

*Primary Examiner* — Haiss Philogene
(74) *Attorney, Agent, or Firm* — The Farrell Law Firm, P.C.

(57) ABSTRACT

A light source driving apparatus is disclosed which includes a power supply including a power supply terminal connected to a first path through which a power source is supplied to a light source and including a feedback terminal for receiving a feedback of the power source supplied to the light source, a feedback resistor connected to the feedback terminal, and a current divider for branching a current flowing into the first path and supplying the branched current to the feedback resistor.

11 Claims, 6 Drawing Sheets

LIGHT SOURCE DRIVING APPARATUS

PRIORITY

This application claims priority under 35 U.S.C. §119(a) to a Korean Patent Application filed in the Korean Intellectual Property Office on Mar. 13, 2009 and assigned Serial No. 10-2009-0021803, the entire disclosure of which is hereby incorporated by reference.

BACKGROUND OF THE INVENTION

1. Field of the Invention

The present invention relates generally to a light source driving apparatus, and more particularly, to an apparatus for driving a light source included in a projector.

2. Description of the Related Art

To drive a projector, a color filter method or a color sequential method is used. A white Light Emitting Diode (LED) is widely used as a light source employed in the color filter method and the light source is driven using Direct Current (DC). A projector of the color sequential method typically uses three-color LED light sources of red, green, and blue and sequentially drives the LED light sources using time-division pulses. For a mobile projector, the color sequential method, which is capable of improving optical efficiency, is preferred.

FIG. 1 is a circuit diagram illustrating a conventional light source driving apparatus for driving an LED light source. Referring to FIG. 1, the light source driving apparatus includes a light source power supply 10, an LED light source 20, a switching device 30, and a feedback circuit comprised of resistors R1 and R2.

The light source power supply 10 supplies a power source necessary to drive the LED light source 20. A current $I_{LED}$ flows into the LED light source 20 from the light source power supply 10 by an operation of the switching device 30 based on an externally input control signal EN. The LED light source 20 generates light of a brightness corresponding to the current $I_{LED}$. The current $I_{LED}$ flowing into the LED light source 20 is branched through a feedback power resistor 40 and the branched current is supplied to a feedback terminal FB. The light source power supply 10 controls the power source necessary to drive the LED light source 20 using a voltage value provided to the feedback terminal FB.

The feedback circuit includes the feedback power resistor 40 which generally uses a high-power rated resistor. However, the resistor functions as a main cause of power loss of the light source driving apparatus and deteriorates the power efficiency of the light source driving apparatus.

SUMMARY OF THE INVENTION

An aspect of the present invention is to address at least the above-mentioned problems and/or disadvantages and to provide at least the advantages described below. Accordingly, an aspect of the present invention provides a light source driving apparatus which can reduce power consumed in a feedback resistor.

In accordance with an aspect of embodiments of the present invention, a light source driving apparatus includes a power supply including a power supply terminal connected to a first path through which a power source is supplied to a light source and including a feedback terminal for receiving a feedback of the power source supplied to the light source, a feedback resistor connected to the feedback terminal, and a current divider for branching a current flowing into the first path and supplying the branched current to the feedback resistor.

In accordance with another aspect of embodiments of the present invention, a light source driving apparatus includes a power supply including a power supply terminal connected to paths through which a power source is supplied to a plurality of light sources and including a feedback terminal for receiving a feedback of the power source supplied to the light sources, a light source driving controller connected to the plurality of light sources to control an on/off driving of the plurality of light sources, a feedback resistor connected to the feedback terminal, and a plurality of current dividers for branching currents flowing into the paths and supplying the branched currents to the feedback resistor.

BRIEF DESCRIPTION OF THE DRAWINGS

The above and other aspects, features and advantages of certain exemplary embodiments of the present invention will be more apparent from the following description taken in conjunction with the accompanying drawings, in which.

Throughout the drawings, the same drawing reference numerals will be understood to refer to the same elements, features and structures.

DETAILED DESCRIPTION OF EMBODIMENTS OF THE PRESENT INVENTION

Reference will now be made in detail to the embodiments of the present invention with reference to the accompanying drawings. The following detailed description includes specific details in order to provide a thorough understanding of the present invention. However, it will be apparent to those skilled in the art that the present invention may be practiced without such specific details.

An embodiment of the present invention illustrates a light source driving apparatus for driving a light source used for a projector. However, the light source driving apparatus of the present invention is also applicable to the apparatuses using a light source as well as the light source driving apparatus of the projector.

Figure 2:
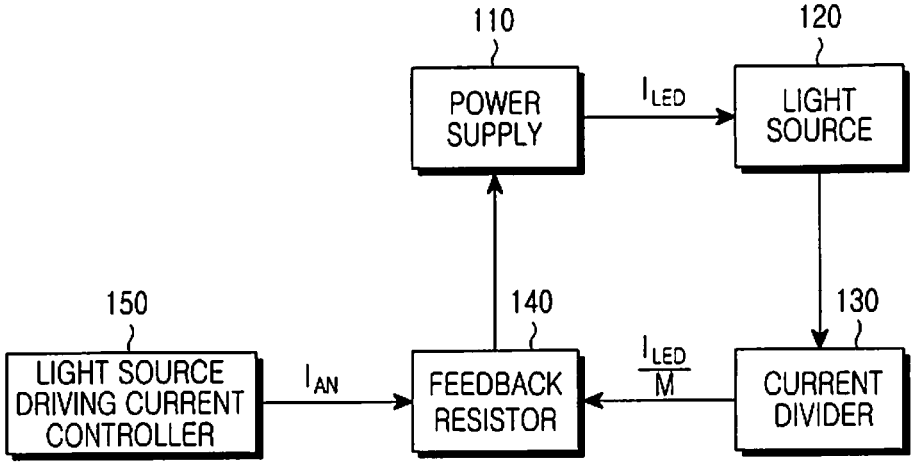
FIG. 2 is a block diagram illustrating a light source driving apparatus according to an embodiment of the present invention.
Figure 3:
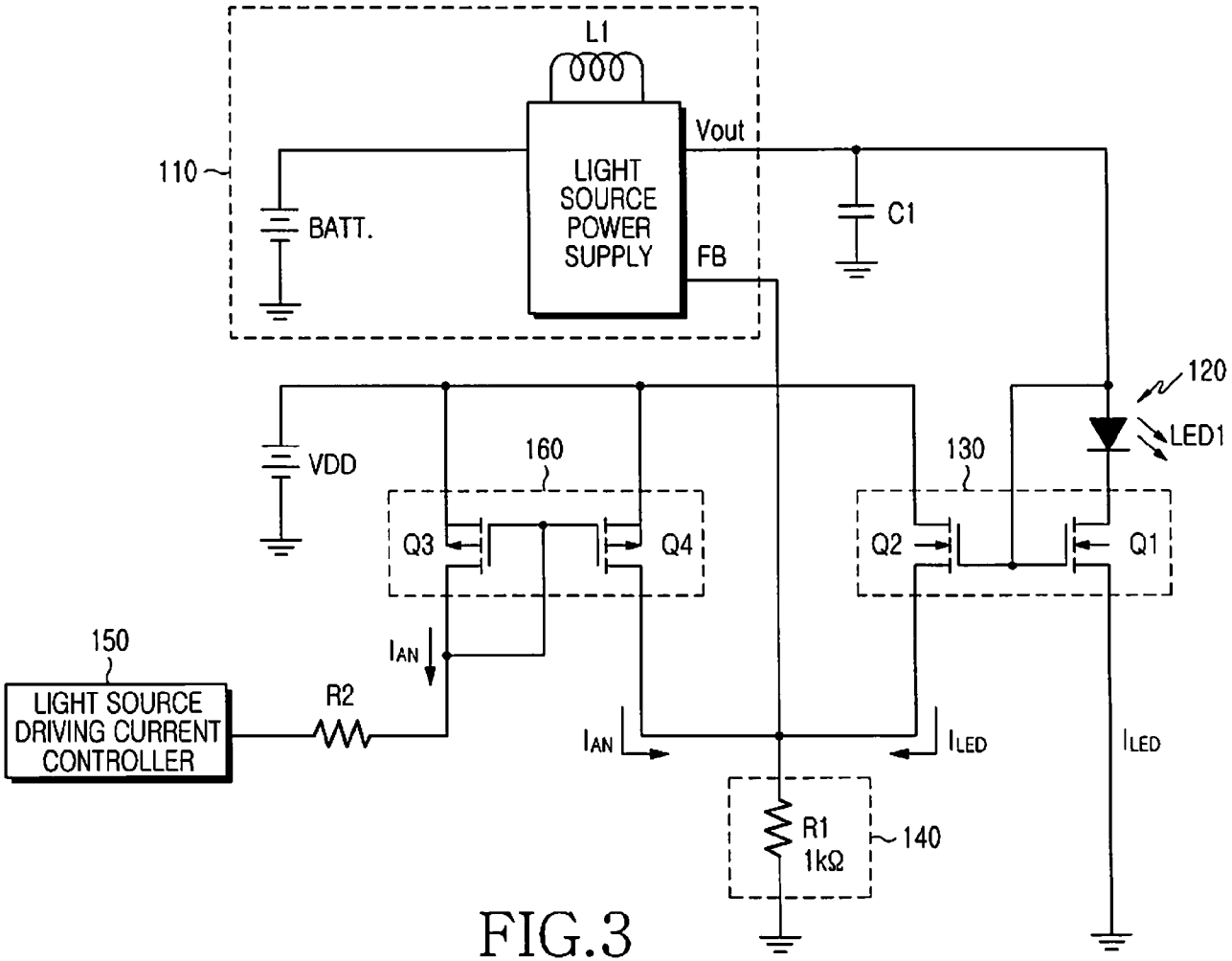
FIG. 3 is a circuit diagram illustrating a light source driving apparatus according to an embodiment of the present invention.

FIG. 2 is a block diagram illustrating a light source driving apparatus according to an embodiment of the present invention, and FIG. 3 is a circuit diagram illustrating a light source driving apparatus according to an embodiment of the present invention. Referring to FIGS. 2 and 3, the light source driving apparatus includes a light source power supply 110, a light source 120, a current divider 130 and a feedback resistor 140.

The light source power supply 110 converts a DC power source, which is supplied from a battery BATT, for example, into a power source necessary to drive a light emitting device and controls a current $I_{LED}$ supplied to the light source 120 by using the feedback of an output voltage. The light source power supply 110 includes a terminal Vout for supplying the power source to the light source 120 and a feedback terminal FB for receiving the feedback of the output voltage. The light source power supply 110 may be a buck-boost converter for example.

The light source 120 is connected to the power supply terminal Vout of the light source power supply 110 and externally generates light corresponding to the current $I_{LED}$ supplied from the light source power supply 110. The light source 120 may be a light emitting device (e.g. LED) which emits light having a brightness level and a wavelength band necessary for a light source used in a projector. For example, the light source 120 may be a white LED generating white light.

The current divider 130 is connected between a path through which the current $I_{LED}$ supplied to the light source 120 flows and the feedback resistor 140 and provides a part of the current $I_{LED}$ supplied to the light source 120 to the feedback resistor 140. The current divider 130 may exclude an element such as a resistor which consumes a relatively high amount of power and may include a semiconductor device such as a transistor which consumes relatively less power. The current divider 130 may adjust the amount of current flowing into the feedback resistor 140 by varying the size or area of the semiconductor device.

The current divider 130 includes a reference voltage source VDD, a first Metal-Oxide Semiconductor Field Effect Transistor (MOSFET) Q1 and a second MOSFET Q2. The first MOSFET Q1 is present on the path through which the current $I_{LED}$ supplied to the light source 120 flows. A gate terminal of the first MOSFET Q1 is connected to the path through which the current $I_{LED}$ flows into the light source 120. The second MOSFET Q2 is connected between the reference power source VDD and the feedback resistor 140. A gate terminal of the second MOSFET Q2 is connected to the gate terminal of the first MOSFET Q1. It is desirable that the first MOSFET Q1 have a greater gate size relative to the gate size of the second MOSFET Q2. The gate size of the first MOSFET Q1 may vary by differently designing the size or area thereof.

Figure 4:
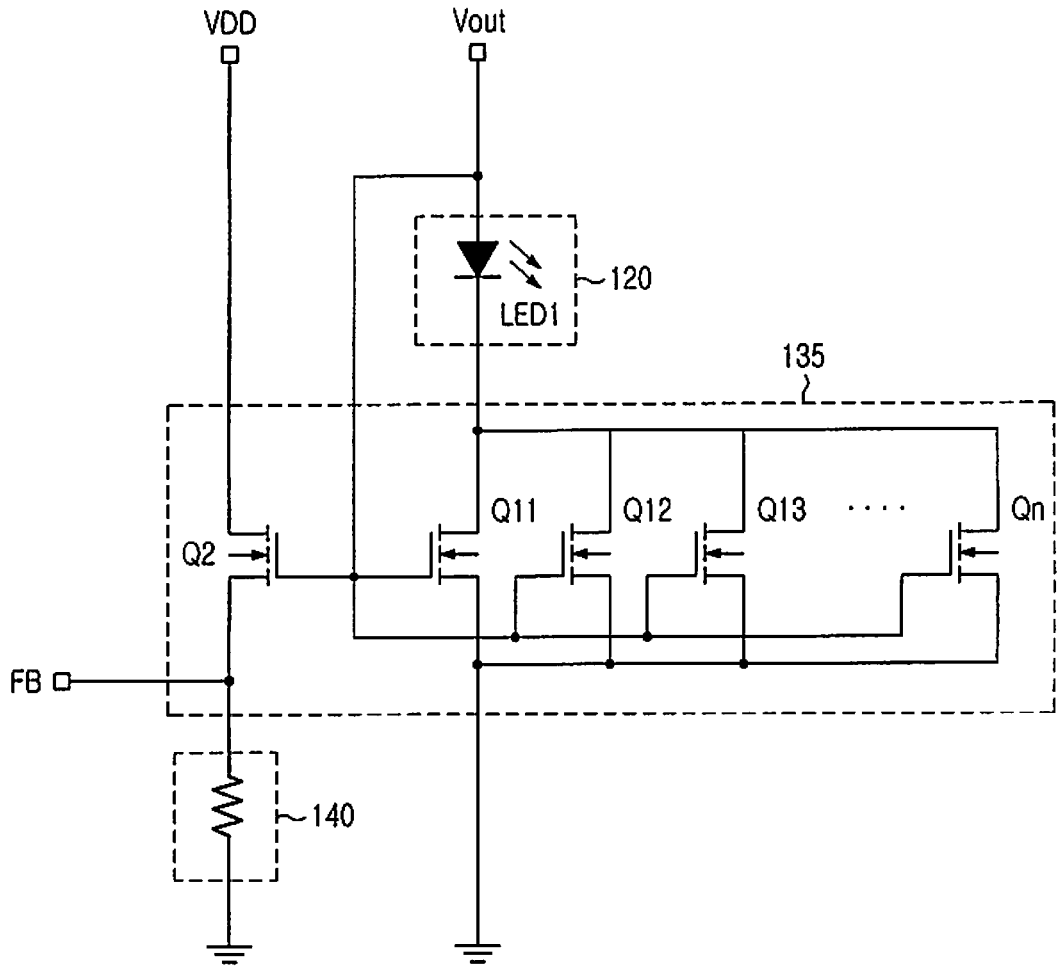
FIG. 4 is a circuit diagram illustrating another example of a current divider included in the light source driving apparatus of the embodiment of the present invention.

FIG. 4 is a circuit diagram illustrating another example of the current divider included in the light source driving apparatus according to an embodiment of the present invention. Referring to FIG. 4, a current divider 135 includes a reference voltage source VDD, a plurality of first MOSFETs Q11, Q12, Q13 and Qn, provided on a path through which a current $I_{LED}$ flows, and a second MOSFET Q2 connected between the reference voltage source VDD and a feedback resistor 140. The gate size of the second MOSFET Q2 is the same as the gate size of each of the first MOSFETs Q11, Q12, Q13 and Qn. However, a current applied to the feedback resistor 140 through the second MOSFET Q2 may be set in inverse proportion to the number of the first MOSFETs Q11, Q12, Q13 and Qn. For example, when the number of first MOSFETs Q11, Q12, Q13 and Qn is 500, the current applied to the feedback resistor 140 through the second MOSFET Q2 may be 1/500 the current $I_{LED}$ supplied to a light source 120.

The feedback resistor 140 is connected to a feedback terminal FB of the light source power supply 110 and to the current divider 130 or 135 so that current may flow from the current divider 130 or 135. Accordingly, a part of the current $I_{LED}$ supplied to the light source 120 is provided to the feedback resistor 140. The light source power supply 110 controls the current $I_{LED}$ based on the current supplied to the feedback resistor 140 so that the current $I_{LED}$ to be supplied to the light source 120 may be maintained at a predetermined level and value.

Figure 1:
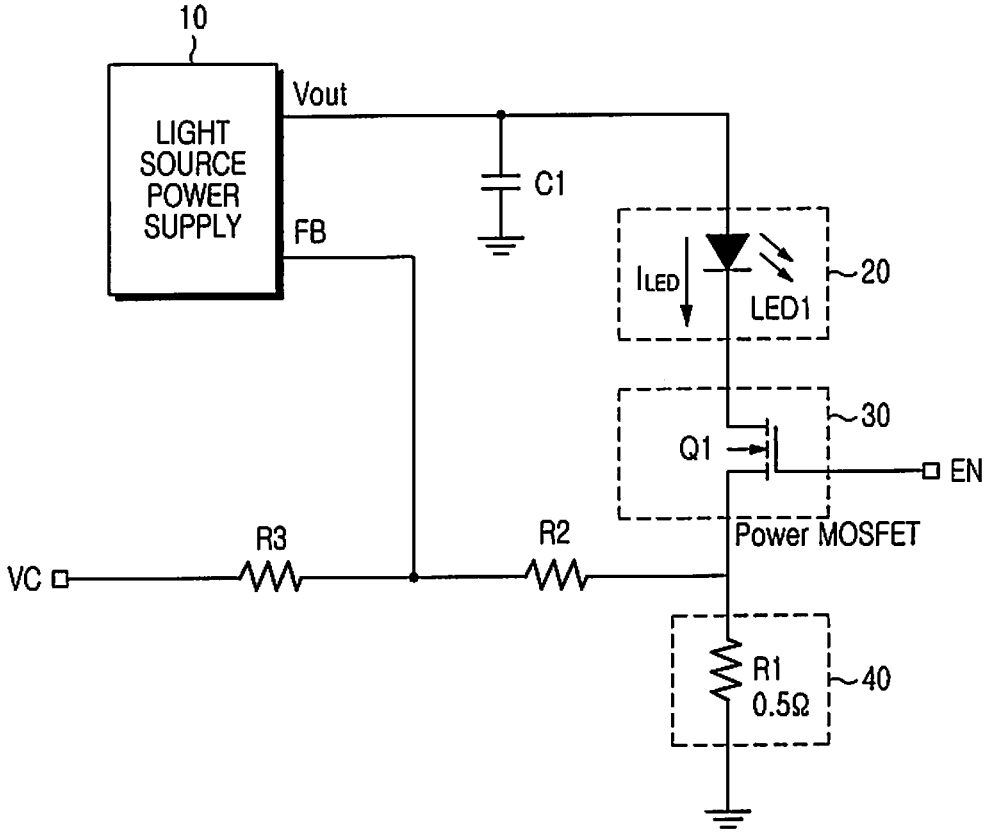
FIG.1 (PRIOR ART)
FIG. 1 is a circuit diagram illustrating a conventional light source driving apparatus.

The light source driving apparatus according to the embodiment of the present invention may further include a light source driving current controller 150 and a control current divider 160 which supply a control current to the feedback resistor 140. The feedback resistor 140 is connected to the feedback terminal FB of the light source power supply 110, and is connected in parallel to the current divider 130 or 135 and the light source driving current controller 150 so that current may flow thereinto from the current divider 130 or 135 and the light source driving current controller 150. The control current divider 160 is connected between the light source driving current controller 150 and the feedback resistor 140. Accordingly, a part of the current $I_{LED}$ supplied to the light source 120 is provided to the feedback resistor 140. The light source power supply 110 controls the current $I_{LED}$ based on the current supplied to the feedback resistor 140 so that the current $I_{LED}$ to be supplied to the light source 120 may be maintained at a predetermined and level value. A current $I_{AN}$ generated from the light source driving current controller 150 may be supplied to the feedback resistor 140. Therefore, the light source driving current controller 150 may control the current $I_{LED}$ supplied to the light source 120 by controlling the current $I_{AN}$. Further, the light source driving current controller 150 may provide to the feedback resistor 140 a signal for controlling the driving timing of the light source 120, for example, a Pulse Width Modulation (PWM) control signal for driving the light source 120. Accordingly, the light source driving apparatus according to the embodiment of the present invention does not need to include an additional switching device (for example, Q1 shown in FIG. 1) for controlling the driving timing of the light source 120.

The control current divider 160 includes a third MOSFET Q3 and a fourth MOSFET Q4. The control current divider 160 shares the reference voltage source VDD included in the current divider 130. Namely, the reference voltage source VDD of the current divider 130 is connected to a drain terminal of the second MOSFET Q2 and to the source terminals of the third and fourth MOSFETs Q3 and Q4 of the control current divider 160. A drain terminal of the third MOSFET Q3 is connected to the light source driving current controller 150 and a drain terminal of the fourth MOSFET Q4 is connected to the feedback register 140. Gate terminals of the third and fourth MOSFETs Q3 and Q4 are connected to each other and are connected between the drain terminal of the third MOSFET Q3 and the light source driving current controller 150. The gate size of the third MOSFET Q3 is desirably the same as the gate size of the fourth MOSFET Q4. Thus, the same current as the current $I_{AN}$ generated from the third MOSFET Q3 is generated through the fourth MOSFET Q4 by an operation of the light source driving current controller 150 and is finally supplied to the feedback resistor 140.

The first and second MOSFETs Q1 and Q2 may be N-type MOSFETs and the third and fourth MOSFETs Q3 and Q4 may be P-type MOSFETs.

The current $I_{AN}$ supplied from the light source driving current controller 150 can be applied to the feedback resistor 140 through the control current divider 160 of the embodiment of the present invention. Moreover, the current $I_{AN}$ supplied from the light source driving current controller 150 can be provided to the feedback resistor 140 without the need of an additional power device such as a high power rated resistor which consumes power. Accordingly, the unnecessary power consumption caused by the power device can be prevented.

A projector may include a plurality of LED light sources, and the plurality of LED light sources may be driven by a color sequential method. The light source driving apparatus of the present invention is applicable to an apparatus for driving a plurality of LED light sources of the projector driven by the color sequential method.

In another embodiment of the present invention, a light driving apparatus for driving a plurality of LED light sources will be described.

Figure 5:
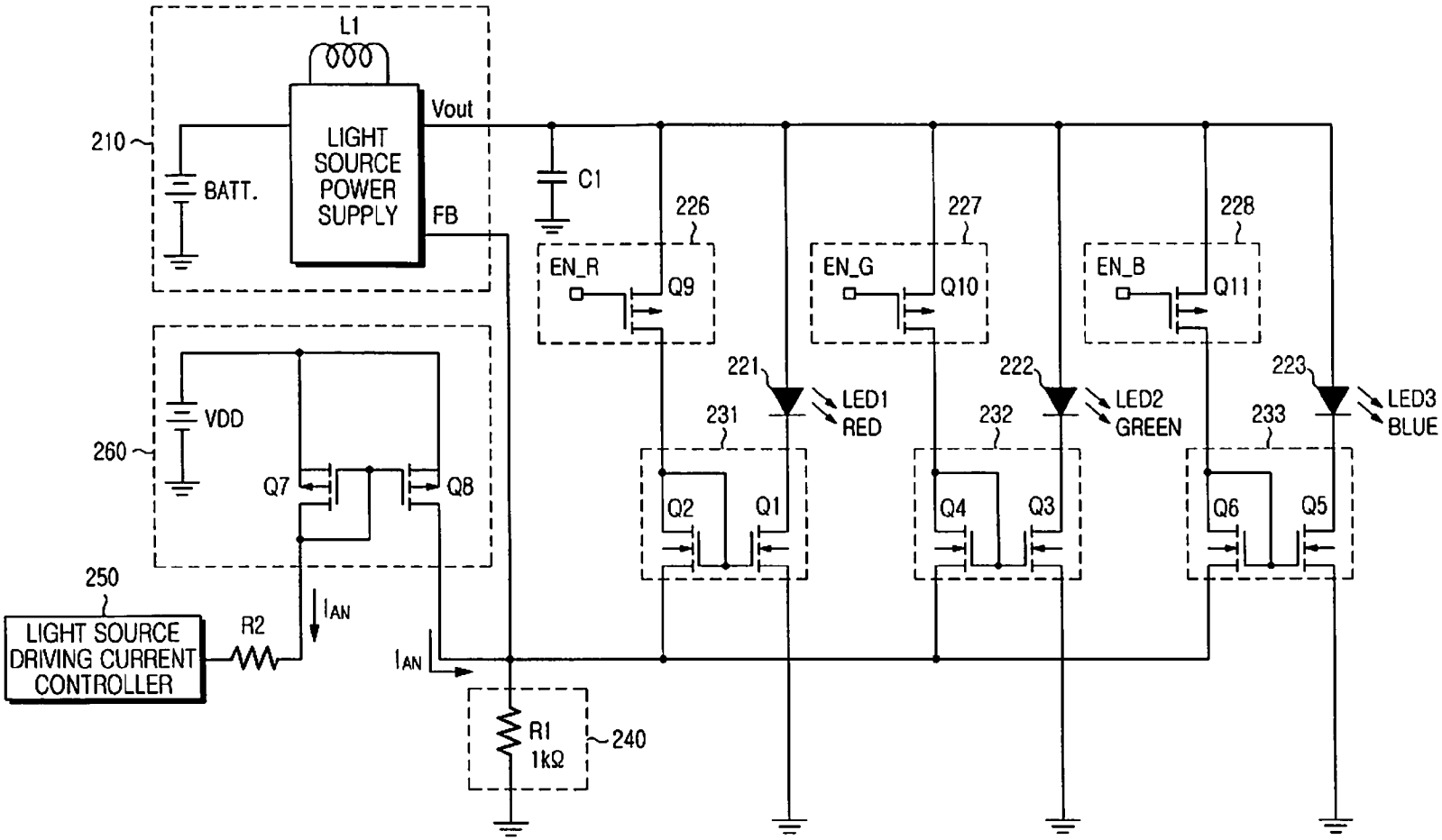
FIG. 5 is a circuit diagram illustrating a detailed construction of a light source driving apparatus according to another embodiment of the present invention.

FIG. 5 is a circuit diagram illustrating a detailed construction of a light source driving apparatus according to another embodiment of the present invention. Referring to FIG. 5, the light source driving apparatus includes a light source power supply 210, a plurality of light sources 221, 222 and 223, a plurality of switching devices 226, 227 and 228 for controlling the driving of the light sources 221, 222 and 223, a plurality of current dividers 231, 232 and 233, and a feedback resistor 240.

The light source power supply 210 converts a DC power source generated from a battery BATT into a voltage necessary to drive each light emitting device at a driving timing of the light emitting device.

Like the light source power supply 110, the light source power supply 210 includes a terminal Vout for supplying a power source to the light sources 221, 222 and 223 and a feedback terminal FB for receiving the feedback of an output voltage. The light source power supply 210 may be a DC-DC converter for controlling the output voltage received through feedback and more desirably may be a buck-boost converter.

The plurality of light sources 221, 222 and 223 are connected in parallel to the power supply terminal Vout of the light source power supply 210. The plurality of light sources 221, 222 and 223 include, for example, red (R), green (G) and blue (B) light emitting devices, respectively. The light sources 221, 222 and 223 receive the power source from the light source power supply 210 and currents flow into the light sources 221, 222 and 223 based on light source control signals (for example, EN_R, EN_G and EN_B) applied to the switching devices 226, 227 and 228. The switching devices 226, 227 and 228 may be MOSFETs.

The current dividers 231, 232 and 233 are connected to the light sources 221, 222 and 223, respectively. A part of the current flowing into the light sources 221, 222 and 223 is applied to the feedback resistor 240. Like the current divider 130, the current dividers 231, 232 and 233 include first and second MOSFETs Q1 and Q2, Q3 and Q4, and Q5 and Q6, respectively. In more detail, the first current divider 231 connected to the first light source 221 includes the first and second MOSFETs Q1 and Q2. The second current divider 232 connected to the second light source 222 includes the first and second MOSFETs Q3 and Q4. The third current divider 233 connected to the third light source 223 includes the first and second MOSFETs Q5 and Q6.

The first MOSFETs Q1, Q3 and Q5 included in the current dividers 231, 232 and 233 may have relatively larger gate size capacities than that of the second MOSFETs Q2, Q4 and Q6, respectively. Then a current flowing into the feedback resistor 240 may be relatively less than a current flowing into each of the light sources 221, 222 and 223. As a result, a power rating of the feedback resistor 240 can be reduced and unnecessary power consumed in the feedback resistor 240 can be minimized.

As in the above embodiment, each of the first MOSFETs Q1, Q3 and Q5 may include a plurality of MOSFETs each having the same gate size as each of the second MOSFETs Q2, Q4 and Q6, respectively. For example, each of the first MOSFETs Q1, Q3 and Q5 may include 500 MOSFETs each having the same gate size as each of the second MOSFETs Q2, Q4 and Q6, respectively. Then the current supplied to the feedback resistor 240 through each of the second MOSFETs Q2, Q4 and Q6 may be set to 1/500 the current supplied to each of the light sources 221, 222 and 223.

The light source driving apparatus according to another embodiment of the present invention may further include a light source driving current controller 250 and a control current divider 260. The light source power supply 210 receives driving timings of the plurality of light emitting devices from the light source driving current controller 250 through the feedback terminal FB and controls the output voltage according to the driving timings. For example, the light source power supply 210 may control voltages for driving the red, green and blue light emitting devices 221, 222 and 223 to be set to 2.3V, 3.8V and 3.6V, respectively.

To this end, the light source driving current controller 250 controls a current $I_{AN}$ supplied to the feedback resistor 240 in consideration of the driving timings of the light emitting devices 221, 222 and 223, so that the light source power supply 210 may generate voltages 2.3V, 3.8V and 3.6V according to the driving timings of the red, green and blue light emitting devices 221, 222 and 223, respectively.

The control current divider 260 may include a reference voltage source VDD, and third and fourth MOSFETs Q7 and Q8. The light source driving current controller 250 supplies the current $I_{AN}$ to the feedback resistor 240 through the control current divider 260, thereby controlling the currents flowing into the red, green and blue light emitting devices 221, 222 and 223.

Figure 6:
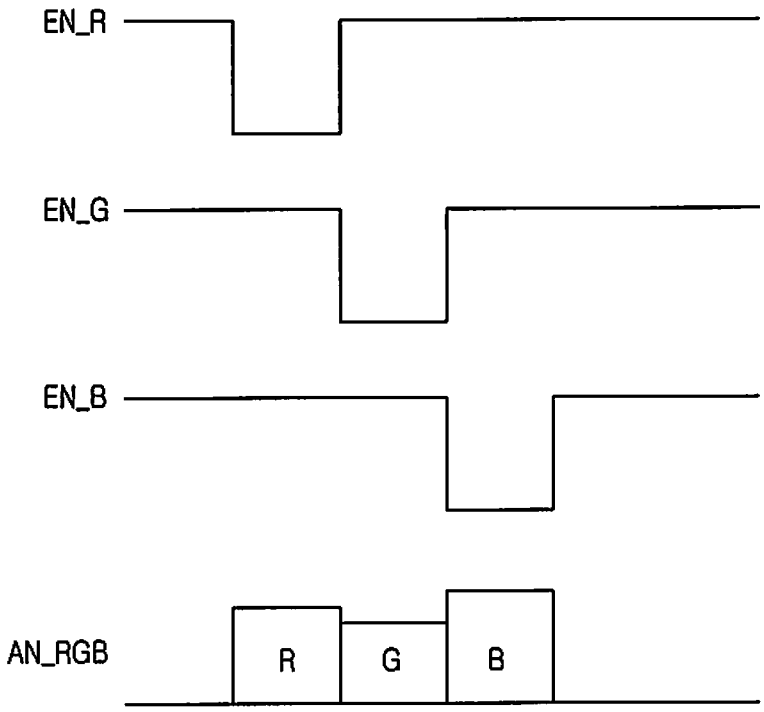
FIG. 6 is a timing chart illustrating driving timings of light emitting devices shown in FIG. 5.

FIG. 6 is a timing chart illustrating driving timings of the light emitting devices shown in FIG. 5. In more detail, FIG. 6 shows red, green and blue enable signals EN_R, EN_G and EN_B defining driving timings of the red, green and blue light emitting devices 221, 222 and 223 of the light source driving apparatus of FIG. 5 and shows an analog pulse signal AN_RGB for controlling the driving currents of the light emitting devices 221, 222, and 223. The analog pulse signal AN_RGB defines driving intervals as pulses according to the timings of the red, green and blue enable signals EN_R, EN_G and EN_B and may have different voltage levels so that the light emitting devices 221, 222 and 223 may be set to have different control currents.

In the embodiment of the present invention, the current divider 130 is comprised of MOSFETs. However, those skilled in the art will appreciate that various modifications can be made in the present invention. For example, transistors of various types may be used in place of the MOSFETs of the current divider 130.

According to the present invention, the light source driving apparatus constructs a feedback circuit that can exclude a power resistor for the feedback of a current flowing into a light source, thereby remarkably reducing power consumed to drive the light source and increasing the efficiency of the light source driving apparatus. Since the light source driving apparatus constructs the feedback circuit that excludes the power resistor of a relatively high cost, the manufacturing cost of the light source driving apparatus can be reduced. Further, the size of the light source driving apparatus can be effectively reduced by removing a large-sized power resistor.

Since the power resistor of a large power rating has a resistance of about 0.1 to 0.5 ohms, a board current deviation of the light source driving apparatus occurs by a parasite resistance such as a pattern resistance or a contact resistance. The board current deviation can be reduced by excluding the power resistor and using a feedback resistance having a resistance of a few hundred ohms to a few kilo ohms.

Although the embodiments of the present invention have been disclosed for illustrative purposes, various modifications, additions and substitutions are possible, without departing from the scope and spirit of the invention as disclosed in the accompanying claims. Accordingly, the scope of the present invention should not be limited to the description of the embodiment, but defined by the accompanying claims and equivalents thereof.

What is claimed is:

1. A light source driving apparatus comprising:

a power supply including a power supply terminal connected to a first path through which power is supplied to a light source and including a feedback terminal for receiving feedback of the power supplied to the light source;

a feedback resistor connected to the feedback terminal; and a current divider for branching a current flowing into the first path and supplying the branched current to the feedback resistor.

2. The light source driving apparatus of claim 1, wherein the current divider includes a first current mirror circuit which connects the first path to the feedback resistor.

3. The light source driving apparatus of claim 2, wherein the first current mirror circuit includes:

a reference voltage source;

a first transistor provided on the first path; and a second transistor connected to the reference voltage source and the first transistor and configured to supply to the feedback resistor current at a level less than the current flowing into the first path.

4. The light source driving apparatus of claim 2, wherein the first current mirror circuit includes:

a reference voltage source;

a plurality of first transistors connected in parallel on the first path; and a second transistor connected to the reference voltage source and the plurality of first transistors and configured to supply to the feedback resistor current at a level which is in inverse proportion to the number of the first transistors.

5. The light source driving apparatus of claim 3, further comprising:

a light source driving current controller configured to generate a control voltage for controlling a driving current of the light source; and a control current divider configured to supply to the feedback resistor a current corresponding to the control voltage generated from the light source driving current controller.

6. The light source driving apparatus of claim 5, wherein the control current divider includes:

a third transistor connected between the reference voltage source and the light source driving current controller to generate a current corresponding to a voltage supplied from the light source driving current controller; and a fourth transistor configured to supply a current corresponding the current generated by the third transistor to the feedback resistor.

7. The light source driving apparatus of claim 6, wherein the first and second transistors are NPN-type transistors and the third and fourth transistors are PNP-type transistors.

8. The light source driving apparatus of claim 7, wherein the first and second transistors are N-type Metal-Oxide Semiconductor Field Effect Transistors (MOSFETs) and the third and fourth transistors are P-type MOSFETs.

9. The light source driving apparatus of claim 5, wherein the light source driving current controller generates a pulse signal for controlling a driving timing of the light source, together with the control voltage.

10. A light source driving apparatus comprising:

a power supply including a power supply terminal connected to paths through which power is supplied to a plurality of light sources and including a feedback terminal for receiving feedback of the power supplied to the light sources;

a light source driving controller connected to the plurality of light sources to control an on/off driving of the plurality of light sources;

a feedback resistor connected to the feedback terminal; and a plurality of current dividers for branching currents flowing into the paths and supplying the branched currents to the feedback resistor.

11. The light source driving apparatus of claim 10, further comprising:

a light source driving current controller configured to generate a control voltage for controlling driving currents of the light sources; and a control current divider configured to supply to the feedback resistor a current corresponding to the control voltage generated from the light source driving current controller.

* * * * *